United States Patent [19]

Bobeth et al.

[11] 4,190,623

[45] * Feb. 26, 1980

[54] RADIATION TREATMENT OF HIGH-POLYMER TEXTILE MATERIALS

[75] Inventors: Wolfgang Bobeth; Adolf Heger; Helmar Pässler, all of Dresden; Hermann Roloff, Berlin; Ellen Patitz, Dresden; Adolf-Ernst Schwind, Deutsch-Wusterhausen; Erwin Zilinski, Berlin, all of German Democratic Rep.

[73] Assignee: Forschungs Institut Fuer Textiltechnologie, Karl Marx Stadt, German Democratic Rep.

[ * ] Notice: The portion of the term of this patent subsequent to Feb. 6, 1995, has been disclaimed.

[21] Appl. No.: 566,334

[22] Filed: Apr. 9, 1975

Related U.S. Application Data

[60] Continuation-in-part of Ser. No. 141,167, May 7, 1971, abandoned, Division of Ser. No. 473,303, May 24, 1974.

[51] Int. Cl.[2] ..... B01D 47/00; B01F 3/04

[52] U.S. Cl. ..... 264/22; 8/115; 8/DIG. 12; 8/DIG. 18; 204/159.12; 204/159/14; 204/159.15; 204/159.16; 204/159.17; 204/159.19; 204/159.20; 264/342 R; 264/343; 430/295; 430/330

[58] Field of Search ..... 204/159.11, 159.12, 204/159.13, 159.14, 159.15, 159.16, 159.17, 159.18, 159.19, 159.2; 8/115, DIG. 12, DIG. 18; 264/343, 22, 342 R

[56] References Cited

U.S. PATENT DOCUMENTS

| | | | |
|---|---|---|---|
| 2,921,006 | 1/1960 | Schmitz et al. | 204/159.15 |
| 3,081,485 | 3/1963 | Steigerwald | 427/43 X |
| 3,330,784 | 7/1967 | Anspon | 260/2.5 |
| 3,681,103 | 8/1972 | Brown | 204/159.13 |
| 3,809,732 | 5/1974 | Chandross et al. | 204/159.16 |

*Primary Examiner*—Richard B. Turer
*Attorney, Agent, or Firm*—Michael J. Striker

[57] ABSTRACT

Two basic methods for texturizing or structurizing high-polymer materials are disclosed. One method resides in selectively irradiating a high-polymer material so as to form chemically active species in the material. The material is contacted with a treating medium which reacts with the chemically active species in such a manner as to cause shrinkage of the material. The texturizing or structurizing effects are due to the fact that the irradiated areas of the material will shrink to a different extent in dependence upon the concentration of the chemically active species and/or that the irradiated areas of the material will shrink to a different extent than the nonirradiated areas of the material. The other method resides in homogeneously irradiating a high-polymer material so as to form chemically active species in the material. The chemically active species in certain areas of the material are at least partially destroyed by contacting selected areas of the material with a suitable medium. The material is again contacted with a treating medium which reacts with the chemically active species in such a manner as to cause shrinkage of the material. The texturizing or structurizing effects are due to the fact that those areas of the material where chemically active species are present will shrink to a different extent in dependence upon the concentration of the chemically active species and/or that those areas of the material where chemically active species are present will shrink to a different extent than the areas where no chemically active species are present.

18 Claims, 6 Drawing Figures

Fig.1
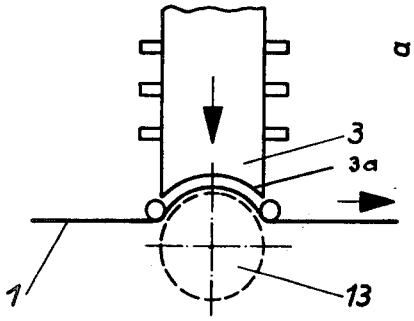
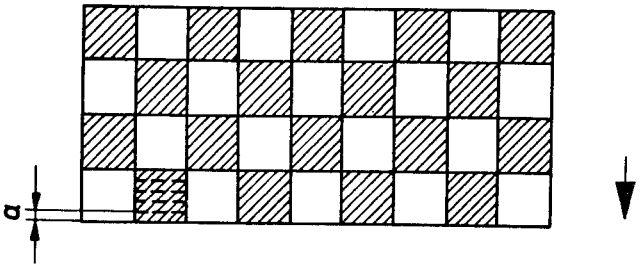
Fig.2
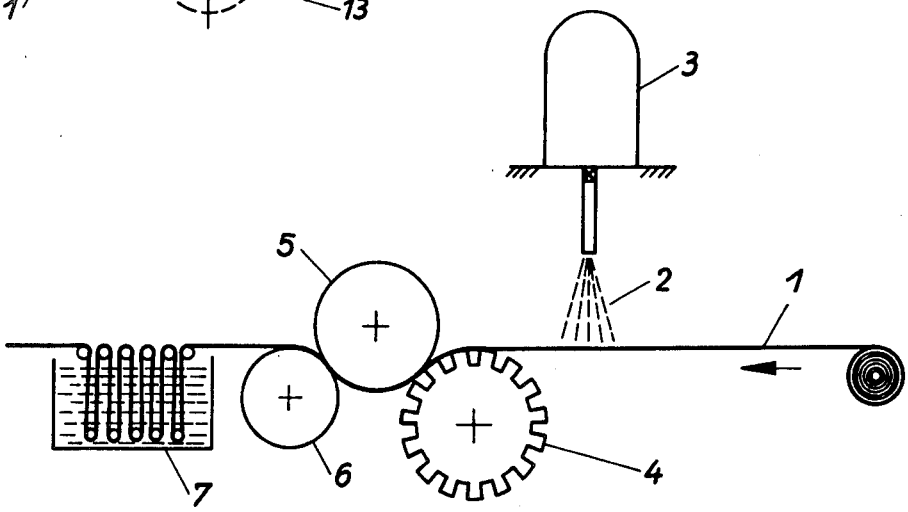
Fig.3
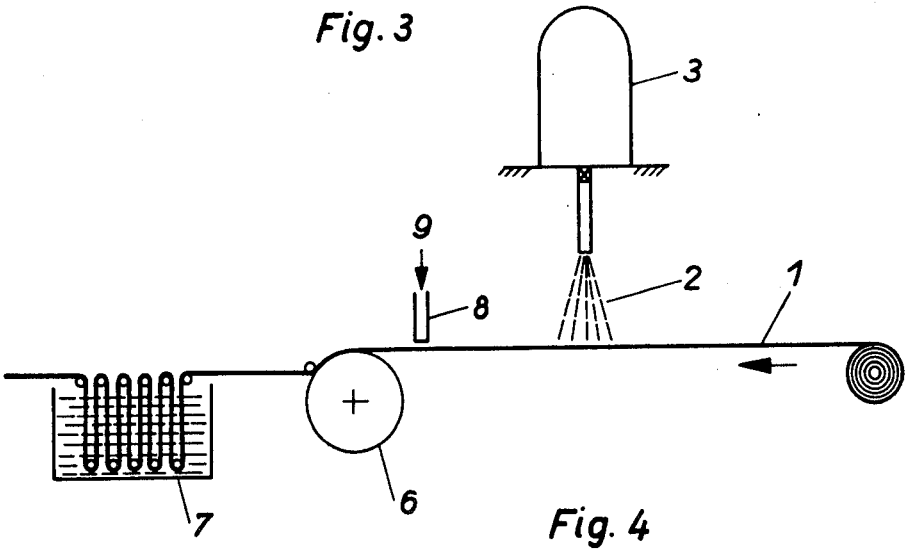
Fig.4

RADIATION TREATMENT OF HIGH-POLYMER TEXTILE MATERIALS

CROSS-REFERENCE TO RELATED APPLICATION

This application is a continuation-in-part of our copending application Ser. No. 141,167 filed May 7, 1971 and entitled "Treating of High-polymeric Materials" which is now abandoned. It is also a division of our copending application Ser. No. 473,303, filed May 24, 1974 and entitled "Treatment of High-Polymer Materials".

BACKGROUND OF THE INVENTION

The present invention relates generally to the processing of high-polymer materials and, more particularly, to the processing of high-polymer textile thread and sheet materials. Still more specifically, the present invention relates to the production of texturized and/or structurized threads, filaments and sheets made of high-polymer materials.

The production of texturized sheets from high-polymer materials, particularly textile sheet materials, is known from the prior art. This is accomplished by subjecting stationary or moving sheets to the influence of high energy radiation, preferably electron beam radiation. A mask, which is provided with suitable apertures, is interposed between the sheet and the radiation source. Thus, the irradiation is localized. Either before, or during, or after, or before and during, or before and after, or during and after, or before and during and after the localized irradiation, the sheet is treated with a medium such as hot water, saturated steam or a vinyl compound in liquid or gaseous phase. This medium, in conjunction with the effects of the localized irradiation, causes shrinkage of the sheet in those portions thereof which have been irradiated which is different from the shrinkage which occurs in those portions of the sheet which have not been subjected to the localized radiation. The result is a sheet which is texturized.

While it is basically possible to obtain a texturized sheet in accordance with the aforementioned prior-art approach, this approach has the disadvantage that the absorption of radiation by the mask causes it to become heated. This requires separate cooling of the mask, particularly when high energy radiation is used, which makes the entire construction rather complicated. Also, if the structural effects which it is desired to obtain are of a complicated nature, control of the movement of the mask is difficult to achieve, and an arrangement on such a basis is necessarily expensive and, in addition, is subject to breakdown and other difficulties.

Insofar as the texturizing of filaments or threads is concerned, it is known from the prior art to compose the filaments of materials having different shrink characteristics so that, when the filament has been subjected to shrinkage, the resultant different degress of shrinkage of the various materials will provide a texturized effect. Here, however, there exists the clear disadvantage that it is necessary to utilize at least two components having different shrink characteristics to make the filaments.

SUMMARY OF THE INVENTION

It is, accordingly, a general object of the present invention to overcome the disadvantages of the prior art.

More particularly, it is an object of the present invention to provide an improved method of processing filaments, threads and sheets made of high-polymer materials, particularly textile threads and textile sheets, so as to obtain texturizing and/or structurizing effects.

A concomitant object of the invention is to provide such an improved method in which the non-homogeneous irradiation utilizing masks is eliminated.

In pursuance of the above objects, and of others which will become apparent hereafter, one feature of the invention resides in a method of processing high-polymer materials wherein first regions of a high-polymer material are irradiated by directing a beam of radiation to the first regions so as to form chemically active species in the first regions. The material also has second regions. The material is contacted with a treating medium which reacts with the chemically active species so as to cause the first and second regions to shrink relative to one another, thereby yielding a texturizing and/or a structurizing effect.

It may be seen that here the movement of the radiation beam, which is preferably an electron beam, is controlled, that is, the beam is moved, so that the necessity for a mask as required heretofore is avoided. The control and intensity of the electron beam may be effected, for instance, by changing the voltage at the Wehnelt cylinder of the electron source. The point of impingement of the electron beam onto the article being treated may be selected at will by utilizing a magnetic scanning system, for example, and by moving the article normal to the direction of scanning.

It is also possible to irradiate the article in question homogeneously rather than selectively or locally. Thus, another feature of the invention resides in a method of processing high-polymer materials wherein a high-polymer material having first and second regions is homogeneously irradiated so as to form chemically active species in the material. The first regions of the material are then contacted with a shrink-preventing medium which is effective for destroying the chemically active species. The material is also contacted with a treating medium which reacts with the chemically active species so as to cause the first and second regions to shrink relative to one another, thereby producing a texturizing and/or structurizing effect.

The chemically active or reaction capable species may, for instance, be ions or radicals. The shrink-preventing medium may be applied either before, or during, or after, or before and during, or before and after, or during and after, or before and during and after the homogeneous irradiation. If the chemically active species in those regions of the material which have been contacted with the shrink-preventing medium are completely destroyed or disintegrated, the treating or shrinkage medium, which may be previously or subsequently applied, will be deactivated in the sense that it will not be able to effect shrinkage of these regions by reaction with the chemically active species. Thus, a different degree of shrinkage is obtained in those regions of the material which have been treated with the de-activating shrink-preventing medium and those regions of the material which have not been treated therewith. Consequently, a texturized or structurized effect in the article being treated is obtained.

The shrink-preventing medium may be a gas, a liquid or a solid such as, for example, hot air, hot water, a profiled heated roller and the like. Different substances may be utilized for the treating or shrinkage medium, examples being liquid and gaseous monomeric solutions, saturated steam and, interestingly, hot air and hot water.

According to the invention, it is particularly advantageous to utilize the shrink-preventing medium partially and/or with different intensity at different locations of the article being treated. Thus, for instance, by a variation of the period of time for which the shrink-preventing medium is allowed to act upon the article, and by a variation of its intensity, various differing structurizing effects may be obtained such as a relief-type decorative pattern or the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a diagrammatic illustration showing an electron accelerator and guide means for guiding an article to be treated;

FIG. 2 is a diagrammatic plan view of the article treated in FIG. 1 to show the structurizing effect obtained;

FIG. 3 is a diagrammatic side-elevational view showing the use of a profiled heated roller as a shrink-preventing medium;

FIG. 4 is a view similar to FIG. 3 but illustrating the use of controllable jets for expulsion of gaseous and liquid media;

DESCRIPTION OF THE PREFERRED EMBODIMENTS

Figure 5:
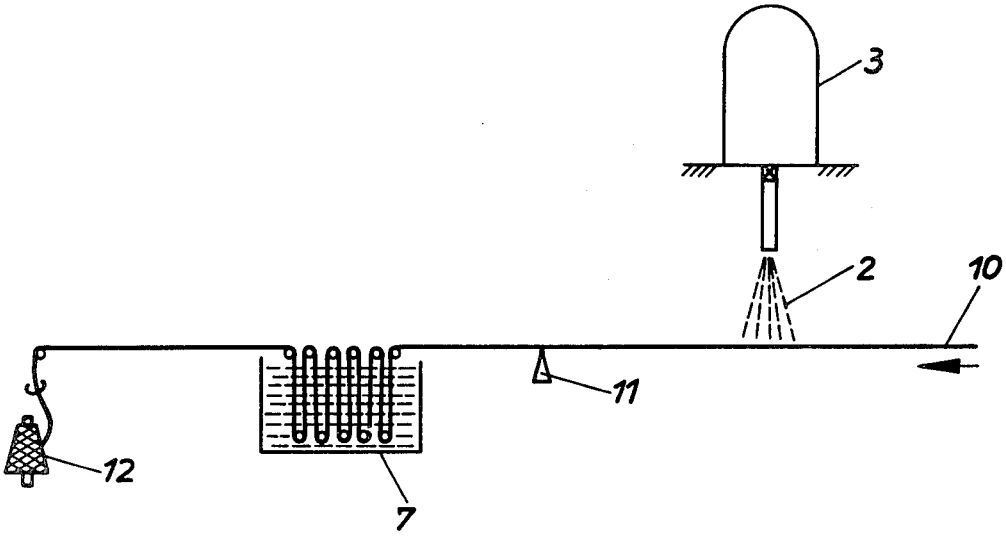
FIG. 5 is a view similar to FIG. 4 but illustrating the use of a heated cutter blade.

The invention intends to produce texturizing and/or structurizing effects in high-polymer materials. Basically, this is accomplished by making localized regions of a high-polymer material capable of undergoing chemical reaction and homogeneously contacting the high-polymer material with a suitable treating or shrinkage medium which is able to react preferentially with these localized regions so as to cause these to shrink relative to the remainder of the material. The particular sequence of steps in the method of the invention is not especially critical as will be discussed more fully below. It is also pointed out that the same effects could be obtained by making all of the high-polymer material chemically reactive and contacting only localized regions of the material with a treating medium. However, the first-mentioned procedure is preferred because of its greater simplicity and because less complications arise. Thus, the invention will be described primarily with respect to the preferred procedure.

In accordance with the invention, ornamental surface texturizing or structurizing is obtained by virtue of a chemical reaction which leads to localized shrinkage differences in a polymeric material when it is homogeneously treated with a suitable treating medium. A particular example of such a chemical reaction is radiation-chemical grafting.

Irradiation of a polymeric material may cause chemically active or reaction capable species such as, for example, free radicals or ions, to be formed therein. The free radicals are formed, according to the invention, only in localized regions or portions of the polymeric material so that locally active regions are obtained.

There are two basic procedures which may be used. According to one concept of the invention, a procedure is used which includes three basic steps, namely: (a) homogeneously irradiating a polymeric material; (b) deactivating selected regions of the polymeric material so that only local regions are chemically active; and (c) contacting the polymeric material with a treating medium which reacts preferentially at or with the locally active regions. The deactivating step is normally performed by contacting selected regions of the polymeric material with a shrink-preventing medium. The shrink-preventing medium may be applied to the polymeric material before, or during, or after, or before and during, or before and after, or during and after, or before and during and after the homogeneous irradiation. The effect of the shrink-preventing medium is to destroy or disintegrate the chemically active species formed by the irradiation. Thus, application of the shrink-preventing medium before or during the homogeneous irradiation prevents formation of the chemically active species in the first place whereas application of the shrink-preventing medium after the homogeneous irradiation causes disintegration of the chemically active species present. It is particularly advantageous, in accordance with the invention, when the shrink-preventing medium is permitted to act at different locations of the polymeric material for different periods of time and/or when the intensity of the shrink-preventing medium is different at different locations' of the polymeric material. By proceeding in this manner, the extent of disintegration of the chemically active species may be controlled and varied. For instance, if a predetermined contact time between the shrink-preventing medium and the polymeric material is required to effect complete disintegration of the chemically active species, then a contact time less than this will cause only partial disintegration of the chemically active species. Therefore, if one area of a polymeric material is contacted with the shrink-preventing medium for less than the predetermined contact time while another area is contacted with the shrink-preventing medium for the full predetermined contact time, it may be seen that the treating medium will be able to undergo some reaction at the first-mentioned area but will be unable to undergo any reaction at the second-mentioned area. The same results may be achieved by varying the intensity of the shrink-preventing medium. Consequently, variation of the contact time between the shrink-preventing medium and the polymeric material and/or variation of the intensity of the shrink-preventing medium allows various structurizing effects to be obtained such as, for example, relief-type decorative patterns and the like.

The shrink-preventing medium may be a gas and/or a liquid and/or a solid. Respective examples are hot air, hot water and heated profiled rollers. Interestingly, hot air and hot water may also serve as a treating or shrinkage medium.

The treating medium may also be applied to the polymeric material before, or during, or after, or before and during, or before and after, or during and after, or before and during and after the homogeneous irradiation. The effect of the treating medium is to react preferentially at or with the locally active regions of the polymeric material and the treating medium will usually be applied to the polymeric material homogeneously or uniformly. The time at which the polymeric material is contacted with the treating medium poses no problems when the shrink-preventing medium is applied no later than during the irradiation. However, in the event that the treating medium is applied before and/or during the irradiation and the shrink-preventing medium is applied only after the irradiation, some care must be exercised to insure that the effects according to the invention are achieved. Thus, since the irradiation is homogeneous and the treating medium is homogeneously contacted with the polymeric material, there exists the possibility of homogeneous shrinkage of the polymeric material occurring before application of the shrink-preventing medium. If the shrinkage is complete, that is, if the reaction between the homogeneously chemically active polymeric material and the treating medium is complete, then subsequent contact of the polymeric material with the shrink-preventing medium will have no effect and the localized shrinkage responsible for the structurizing effects will not be obtained. Therefore, in any case where the shrink-preventing medium is applied to the polymeric material after the irradiation and the treating medium is applied to the polymeric material prior to the shrink-preventing medium, care must be exercised to insure that the elasped time between the irradiation and the application of the shrink-preventing medium is not so great that the reaction between the treating medium and the polymeric material is complete. This will not be difficult where the reaction between the treating medium and the polymeric material is a slow one. On the other hand, if the reaction is a rapid one, it might be favorable to contact the shrink-preventing medium with the polymeric material either prior to or simultaneously with the treating medium.

The second procedure which may be used in accordance with the invention includes two basic steps, namely: (a) selectively irradiation a polymeric material; and (b) contacting the polymeric material with a treating medium which reacts preferentially at or with the locally active regions. The selective irradiation may involve directing the radiation beam to selected areas of the polymeric material and/or changing the intensity of the radiation beam as it is moved over the polymeric material. If the radiation beam is directed to selected areas of the polymeric material, then chemically active species will be formed in these selected areas only to obtain locally active regions. On the other hand, it is also possible to continuously move the radiation beam over the polymeric material but to change the intensity of the radiation beam during its movement. This will have the effect of forming chemically active species in all regions of the polymeric material but with the concentration or quantity of the chemically active species being different in different areas of the polymeric material. The treating medium will then react to a different extent with the different areas thereby causing a different degree of shrinkage in the different areas. Of course, it is further possible to direct the radiation beam to selected areas of the polymeric material and to also change the intensity of the radiation beam.

In this procedure, the treating medium may also be applied to the polymeric material before, or during, or after, or before and during, or before and after, or during and after, or before and during and after the irradiation. Again, the effect of the treating medium is to react preferentially at or with the locally active regions of the polymeric material and the treating medium is usually applied to the polymeric material homogeneously or uniformly. Generally speaking, the effects according to the invention are obtained by virtue of relative shrinkage of different regions of a polymeric material. This is basically achieved in one of two ways. One of these is the case where chemically active species are present in certain regions of the polymeric material and the remaining regions of the polymeric material are devoid of chemically active species. In the three-step procedure of the invention, this is accomplished by homogeneously irradiating a polymeric material and by completely disintegrating, or preventing formation of, chemically active species in selected areas of the polymeric material. In the two-step procedure of the invention, this is accomplished by directing the radiation beam to selected areas of the polymeric material only. The second manner in which relative shrinkage of different regions of a polymeric material may be obtained is the case where chemically active species are present in all areas of the polymeric material but where the concentration or quantity of the chemically active species is different in different areas of the polymeric material. In the three-step procedure of the invention, this may be accomplished by homogeneously irradiating a polymeric material and by then regulating the contact time between the shrink-preventing medium and the polymeric material and/or by then regulating the intensity of the shrink-preventing medium so that the chemically active species in selected areas of the polymeric material is only partially disintegrated rather than being completely disintegrated. Here, there exists also the possibility of contacting the shrink-preventing medium with all areas of polymeric material and regulating the contact time and/or the intensity of the shrink-preventing medium as just described. In the two-step procedure of the invention, this may be accomplished by directing the radiation beam over all areas of the polymeric material but changing the intensity of the radiation beam during its movement, that is, by regulating the radiation dose applied to different areas of the polymeric material. This may also be done by regulating the time for which the radiation beam is directed to different regions of the polymeric material. Of course, a third possibility exists for obtaining relative shrinkage of different regions of a polymeric material. This is the case where certain areas of a polymeric material are devoid of chemically active species and chemically active species are present in the remaining areas but the concentration or number of the chemically active species in different ones of the remaining areas is different.

The extent to which the treating medium will react with the polymeric material will depend upon the concentration or number of the chemically active species with the limiting cases being zero concentration with no reaction and maximum concentration with maxium reaction. Correspondingly, there will be zero shrinkage of the polymeric material and maximum shrinkage thereof. It should be mentioned here that treating media may be used which are able to cause shrinkage of those regions of a polymeric material where no chemically active species are present. If the polymeric material includes regions where no chemically active species exist, what happens under such circumstances is that the degree of shrinkage is these regions is different from that in those regions where chemically active species are present. Examples of treating media which are capable of causing shrinkage of both those regions which contain chemically active species and those regions which are devoid of chemically active species are hot air, hot water and saturated steam.

It will be apparent that a polymeric material is locally and/or selectively activated in accordance with the invention in the sense that different regions of the polymeric material have different concentrations or numbers of chemically active species, i.e. have different chemical activities. Similarly, the shrinkage obtained by reaction between the treating medium and the polymeric material is localized and/or selective since it is a function of the concentration or number of the chemically active species.

The irradiation will usually be performed with high energy radiation. Advantageously, an electron beam is used for the irradiation. However, other high energy radiation may also be used, such as for example, x-rays and gamma rays.

As mentioned earlier, the regions of a polymeric material in which chemically active species such as free radicals and/or ions are formed are chemically active. These regions are capable of undergoing or participating in a host of secondary reactions such as cross-linking of the polymer, degradation of the polymer, recombination reactions and grafting copolymerization or polymerization. It is reactions such as these which cause shrinkage of the polymeric material. The shrinkage resulting from these reactions is localized and/or selective since the polymeric material is selectively activated and it is such localized and/or selective shrinkage which produces an ornamental surface structurizing or texturizing. Thus, a prerequisite for the method of the invention is the presence of selectively activated regions in a polymeric material as well as the presence of a treating medium such as, for instance, a monomeric vinyl substance, which is able to react at or with the chemically active regions.

The treating medium may effect structurizing or texturizing of a polymeric material in two ways. On the other hand, the treating medium may cause local differences in the structure of the polymeric material due, for example, to cross-linking or decomposition reactions in the activated regions thereof. As a result of these local differences in structure, the regions of different chemical activity of the polymeric material will shrink relative to each other. On the other hand, the treating medium may cause relative shrinkage of the regions of different chemical activity of a polymeric material by chemically reacting with the high-polymer material in the activated regions thereof, an example of treating media which may chemically react with a high-polymer material being the class of monomeric substances which may graft onto the polymeric material.

The essential point is that the treating medium or media used be capable of interacting with the activated regions of a polymeric material. Whether the treating medium is able to cause shrinkage of those regions of a polymeric material which are not chemically active also is of secondary importance.

As outlined previously, in accordance with the invention, the polymeric material is irradiated and either: (1) before, or (2) during, or (3) after, or (4) before and during, or (5) before and after, or (6) during and after, or (7) before and during and after the irradiation, the polymeric material is contacted with a medium which, in conjunction with the influence of the irradiation, leads to shrinkage in the activated regions of the polymeric material which is different from that which may occur in the chemically inactive regions of the latter and which depends upon the degree of chemical activity. It is again emphasized that the treating medium may or may not be able to cause shrinkage of the chemically inactive regions of the polymeric material but must have the ability to cause shrinkage when used in combination with the effects of the energetic radiation. For example, a 20% solution of acrylamide causes shrinkage only when the acrylamide grafts onto the chemically active regions of the polymeric material. It is pointed out here that, where a treating medium is used which grafts onto the polymeric material, the grafting is primarily for the purpose of simultaneously causing shrinkage so that selective grafting thus leads to an ornamental surface structure.

Where the polymeric material is contacted with a treating medium prior to or during the irradiation, it is preferable to use a monomeric substance as a treating medium. Such a substance will graft onto the chemically active regions of the polymeric material thereby causing selective shrinkage and a resultant relief-type effect leading to structurizing or texturizing of the polymeric material. The monomeric substance may be either in liquid or gaseous phase. The required radiation dose for initiating the grafting reaction is a function of the monomeric substance used as well as of the particular high-polymer constituting the polymeric material.

Where treatment of the polymeric material with a treating medium is performed subsequent to the irradiation, i.e., the so-called "prior irradiation technique", hot air, hot water or saturated steam, for example, may be used as the treating medium. As already mentioned, treating media of this type are capable of causing shrinkage of the chemically inactive regions of a polymeric material also and, where these treating media are used and such regions are present, structurizing or texturizing effects are produced at least in part because the chemically inactive regions of the polymeric material shrink to a different degree than the chemically active regions of the latter. Such treating media cause changes in the structure of the polymeric material to occur in the chemically active regions thereof and, depending in part upon the type of polymer constituting the polymeric material, the changes in structure will be due to either cross-linking or degradation reactions. However, it is also possible to use, for instance, a monomeric substance as the treating medium, in which case the structurizing effects are a result of grafting of the monomeric substance to the polymeric material in the chemically active regions of the latter.

In a case where the treating medium is contacted with the polymeric material both before and after the irradiation, the polymeric material may, prior to the irradiation, be treated with a monomeric substance in order to obtain a grafting reaction. By then treating the polymeric material, subsequent to the irradiation, either with a treating medium of the type which is able to cause shrinkage of the chemically inactive regions of the polymeric material also or with the same monomeric substance which as used prior to the irradiation or with a different monomeric substance, the effects according to the invention may be enhanced. On the other hand, the effects in accordance with the invention will likewise be obtained when, before the irradiation, the polymeric material is contacted with a substance which favors, for example, cross-linking, and if the polymeric material is then treated, after the irradiation, with a treating medium of the type capable of causing shrinkage of the chemically inactive regions thereof also. Examples of substances which favor cross-linking are polyfunctional monomeric substances such as divinylbenzol and triallylcyanurate.

Where treatment of the polymeric material is carried out both during and after the irradiation, the treating medium used during the irradiation is advantageously either a monofunctional monomeric substance (which causes grafting) or a polyfunctional monomeric substance (which causes cross-linking). The treating medium utilized subsequent to the irradiation may be either a monomeric substance or, again, a substance capable of causing the chemically inactive regions of the polymeric material to shrink also. This variation of the method of the invention, i.e. where the polymeric material is contacted with a treating medium both during and after the irradiation, is a combination of the variations listed under (2) and (3) above.

It is pointed out that the variant of the method of the invention where the polymeric material is treated with a treating medium both before and during irradiation has not been discussed in detail since it is a combination of the variations listed under (1) and (2) above. Similarly, that variation where the polymeric material is contacted with a treating medium before, during and after the irradiation is a combination of the others.

The sequence of steps in the method of the invention, although not necessarily critical, may be so chosen as to obtain optimum processing conditions. If, for example, the high-polymer constituting the polymeric material is of such a nature that the life of the chemically active species, e.g. free radicals or ions, formed by the irradiation is relatively short, then the polymeric material is advantageously contacted with the treating medium before or during the irradiation in order to insure that adequate reaction occurs. On the other hand, if the high-polymer is such that the life of the chemically active species is relatively long, then the treatment with the treatment medium favorably follows the irradiation.

The length of time for which the polymeric material is irradiated depends basically upon two factors. The first is the amount of time it takes for the radiation dose necessary to produce a sufficient quantity of chemically active species to be absorbed by the polymeric material. The second is the power output of the radiation source used. In accordance with the invention, it is particularly advantageous when the radiation source is an electron accelerator, although other radiation sources are also suitable. The greater the power output of the radiation unit, the less will be the time required for absorption of a predetermined radiation dose. For instance, where an electron accelerator generates 1 kW and the scanning beam is substantially planar, that is, the surface of the electron beam beneath the scanner of the electron accelerator is homogeneous, the time required for a polymeric material is absorb a radiation dose of about $10^7$ rad is approximately 1 minute. This means that, in a continuous process, the polymeric material to be irradiated may be conveyed at a rate of about 30 cm/min (1 minute being the residence time in the radiation field). Where the output of the electron accelerator is 10 kW, the polymeric material to be irradiated may, then, be permitted to pass through the radiation field at a rate of 3 m/min. For still higher outputs, the rate of passage of the polymeric material through the radiation field may be further increased. It will be seen that the length of time required for the irradiation process is determined by the radiation dose to be absorbed by the polymeric material and by the power output of the radiation unit.

The radiation dose to be absorbed by the polymeric material is dependent upon both the type of high-polymer constituting the latter and the intensity of the final effect which it is desired to achieve. However, the interrelationship between the radiation dose absorbed and the quantity of the treating medium which is contacted with the polymeric material (or, where the treating medium comprises a mixture or solution, the concentration of that substance in the treating medium which reacts with the chemically active regions of the polymeric material) must also be taken into account here. Below are listed some examples of high-polymer which may suitably be used and the corresponding radiation doses which are advantageously utilized for them: (a) polyamide, $5.10^5$–$10^7$ rad; (b) polyester, $10^6$–$5.10^7$ rad; (c) polyolefine, $10^6$–$5.10^7$ rad; and (d) polyacrylonitrile, $5.10^5$–$10^7$ rad.

The energy of the electrons in the electron beam used for the irradiation, or the energy of any other type of radiation used, is dependent upon the thickness of the polymeric material to be irradiated. The electron energy is favorably between 100 keV and 1.5 Mev although it may be as high as 3 Mev. Polymeric materials having a mass per unit area between approximately 100 $g/m^2$ and 5000 $g/m^2$ may be irradiated using a range of electron energy from about 100 keV to 1.5 Mev.

The irradiation is advantageously carried out at room temperature, that is, at about 20° C. However, the irradiation may be performed at any temperature between about 20° C. (where the irradiated polymeric material is cooled) and 100° C. (where the irradiated polymeric material is not cooled).

The length of time for which the polymeric material is to be contacted with the treating medium is determined by the rate at which the latter takes effect. On the other hand, the rate at which the treating medium takes effect is itself influenced by different factors, in particular, by the temperature and the concentration of the treating medium. Normally, the length of time for which the polymeric material is contacted with the treating medium lies approximately between 1 and 30 minutes.

Where the treating medium is a monomeric substance, the polymeric material is contacted with the same at a temperature between substantially 20° and 80° C. Where hot air, hot water or saturated steam are utilized as treating media, contact with the polymeric material is made at a temperature between substantially 80° and 150° C.

In general, hot media and monomeric substances in liquid or gaseous phase may find an application as treating media. More particularly, vinyl compounds may be used for this purpose and especially suitable substances are acrylamide, acrylic acid, styrene, acrylonitrile, itaconic acid, divinylbenzol, triallylcyanurate, polyfunctional monomeric substances, hot air, hot water and saturated steam. The treating medium may be in the form of a mixture or solution.

When a polymeric material which has been chemically activated by irradiation is brought into contact with a suitable treating medium, the prerequisites for shrinkage of the chemically active regions which is different from that of the chemically inactive polymeric material come into existance. However, it may some-times be desirable to prevent shrinkage of at least the chemically active regions for some period of time, perhaps even for several days. This might be the case when the polymeric material is to undergo a subsequent processing step such as, for instance, a coloring operation. Under such circumstances, the polymeric material may be subjected to a tension when it is contacted with the treating medium, as a result of which shrinkage is prevented although at least the conditions for latent shrinkage of the chemically active regions of the polymeric material exist. When the polymeric material is then further processed subsequently (in a coloring bath, for example) and the tension is released, the polymeric material will undergo shrinkage at this time due to the elevated temperature of the coloring bath.

It is pointed out here that the thickness of the polymeric material should be taken into account in both the irradiating step and the step of contacting the polymeric material with the treating medium. Thus, for the same radiation output of the radiation source, an increase in the thickness of the polymeric material does not require that the rate of passage thereof through the radiation field be changed if the energy of the radiation beam, or the particles in the radiation beam, is adjusted in accordance with the thickness of the polymeric material to be irradiated. On the other hand, the length of time for which the polymeric material is to be contacted with the treating medium is influenced by the thickness of the polymeric material insofar as longer contact times are required for the treating medium to permeate or penetrate the polymeric material as the thickness of the latter increases.

The thickness of the polymeric material may also be a factor in the step of contacting the polymeric material with the shrink-preventing medium since, as the thickness of the polymeric material increases, a longer time may be ncessary for the effects of the shrink-preventing medium to make themselves felt. However, the shrink-preventing medium does have the ability to act rather rapidly, and contact times of only a few seconds are possible although in certain instances the contact time might have to be greater than this. Preferably, the time of contact between the shrink-preventing medium and the polymeric material is between about 0.2 and 20 seconds and, advantageously, between about 1 and 5 seconds. Advantageously, the shrink-preventing medium has a temperature between about 70° and 200° C. although the temperature of the shrink-preventing medium might in certain cases lie below or above these values. Most preferably, however, the temperature of the shrink-preventing medium lies between about 130° and 180° C. The temperature of the shrink-preventing medium might also be a factor in determining the length of time for which the polymeric material is contacted therewith.

In some instances, it may be desirable to wash the polymeric material such as, for example, when residual treating medium is to be removed therefrom. The washing processes conventionally used in the textile industry may be used here also and the length of time for which the polymeric material is to be washed is similarly conventional. The polymeric material may be washed in so-called "wide" washing machines or in so-called "narrow" or "rope" washing machines, for example, and the washing process is carried out at a temperature between about 40° and 80° C.

Subsequent to washing of the polymeric material, the latter may be dried. And dryers conventionally used in the textile industry may be used for this purpose, particularly hot-air dryers. The drying temperature and the length of time required for drying the polymeric material are both dependent upon the thickness of the latter, a thin fabric requiring less time to dry than a thick fabric.

Generally, all natural and synthetic high-polymers may be processed in accordance with the method of the invention. In particular, polyamides, polyesters, polyolefines, cellulose and polyacrylonitrile may be so processed. Specific but non-limiting examples of some of the above materials are polyamide-6, polyamide-6.6, polyethyleneterphthalate, polyethylene, polypropylene, PAN-homopolymer and PAN-copolymer (PAN being an abbreviation for polyacrylonitrile).

Where the treating medium is a monomeric substance and grafting occurs, permanent changes in the properties of the polymeric material may be produced. For example, the coloring and dyeing characteristics may be improved as may be the water absorption and dirt-repellant characteristics of the polymeric material. Referring now to the drawings, and discussing first the embodiment illustrated in FIGS. 1 and 2, it will be assumed that a sheet material fabric having a width of two meters and a mass per unit of 100 grams per square meter is to be treated. It is further assumed that the sheet material fabric is composed of polyamide. The sheet material article, which is identified with reference numeral 1, is passed around a perforated roller 13 and thereby passed directly beneath the Leonard window 3*a* of an electron accelerator 3 at a speed of 6 meters per minute. The direction of movement of the sheet material 1 is indicated by arrows in FIGS. 1 and 2 and the direction of movement of the electrons emitted by the electron accelerator 3 is likewise shown by an arrow in FIG. 1. The electron accelerator 3 is well known to those skilled in the art and need not be further described except to point out that, for this embodiment, it is assumed that the electron flow is 15 milliaperes and that the electron beam emitted by the electron accelerator 3 is assumed to have an energy of 500 kilo electron volts.

Both the sheet material 1 and the Leonard window 3*a* of the electron accelerator 3 are cooled by means of air which is forcibly blown through a perforated roller 13 and passes through the sheet material 1 onto the Leonard window 3*a* of the electron accelerator 3. The scanning frequency of the electron beam is 50 azimuth and the electron beam diameter after emission from the Leonard window 3*a* of the electron accelerator 3 is 2 millimeters. The pulsing frequency is 5 kilohertz and the pulse length 0.1 milliseconds. After five passes, the electron beam is phase-shifted through one pulse period.

When the thus irradiated sheet material 1, which has been locally irradiated only, is subsequently treated in a 20% acrylamide solution, a structurized article is obtained having at its surface squares of 10 millimeter dimension as shown in FIG. 2. For illustrative purposes, the reference character "a" has been used here to denote the diameter of the electron beam used for the irradiation. The squares having one surface appearance, that is, the squares which have been shrunk to a greater degree, alternate with the squares having a different surface appearance and which have been shrunk to a lesser degree. The article obtained also has a greater capability for absorbing moisture than it had prior to the treatment.

In the embodiment of FIG. 3, the same reference numerals as in the preceding embodiment identify identical components. A polyamide sheet material 1, having a mass per unit area of 100 grams per square meter, travels in the direction of the arrow through the electron radiation field 2 of the electron accelerator 3 which here has a radiation capability of 25 kilovolts. The speed of advancement of the sheet material 1 is such that it absorbs a radiation dose of $5.10^6$ rad.

After being thus irradiated, the sheet material 1 passes between a pair of rollers 4 and 5. The roller 4 is a profiled roller having a surface structure corresponding to the surface appearance desired to be produced on the sheet material 1. The roller 4 is heated to 190° C. The roller 5 has a smooth surface and is maintained at, or substantially at, room temperature. The sheet material 1 is here homogeneously irradiated, in contrast to the embodiment of FIGS. 1 and 2 where local irradiation took place. At the points or in the regions where the sheet material 1 makes contact with the heated roller 4, the reaction capable or chemically active species produced by the irradiation are abruptly collapsed or destroyed. In order to assure that a heat transfer within the sheet material 1 does not cause any blurring of the desired structure, a cooling roller 6 is provided which cools the sheet material 1.

When the sheet material 1 is subsequently treated in a 20% acrylamide solution having a temperature of 30° C. for a period of 20 minutes, which solution is here accommodated in a container or bath 7, grafting of acrylamide takes place on those portions of the sheet material 1 which were not de-activated by means of the heat when the sheet material 1 contacted the heated portions of the roller 4. Thus, localized shrinkage and a surface structure effect are obtained.

In the embodiment of FIG. 4 we have again shown those components which are identical with the components illustrated in the previous embodiments with like reference numerals. The electron radiation field 2 of the electron accelerator 3 is again shown and the direction of movement of the sheet material 1 is again indicated by an arrow. Instead of the rollers used in the embodiment of FIG. 3, the embodiment of FIG. 4 utilizes nozzles 8 which can be individually controlled over the entire width of the sheet material 1 and which blow heated air 9 through the sheet material 1 in accordance with the structure which it is desired to obtain. The cooling roller 6 assures that no heat transfer takes place within the sheet material 1 which would, concomitantly, cause a blurring of the desired surface structure. Subsequent grafting takes place in a grafting bath 7 as in the embodiment of FIG. 3.

In FIG. 5 we show an embodiment in which a strand or a plurality of polyamide threads or filaments 10 is passed, in the direction indicated by the arrow, through the electron beam 2 of the electron accelerator 3 with a speed such that the filaments absorb a radiation dose of $5.10^6$ rad. After the thus-obtained homogeneous irradiation, the outer capillary fibers are brought into contact with the edge of a heated cutter or knife blade 11, whereby de-activation of the reaction capable species produced by the irradiation takes place. The species thus de-activated are no longer active during subsequent grafting with acrylamide in the grafting bath 7. This results in differential shrinkage of the capillary fibers and, thus, in a texturized and structurized polyamide fiber bundle 12 which is taken up onto a bobbin as shown.

Figure 6:
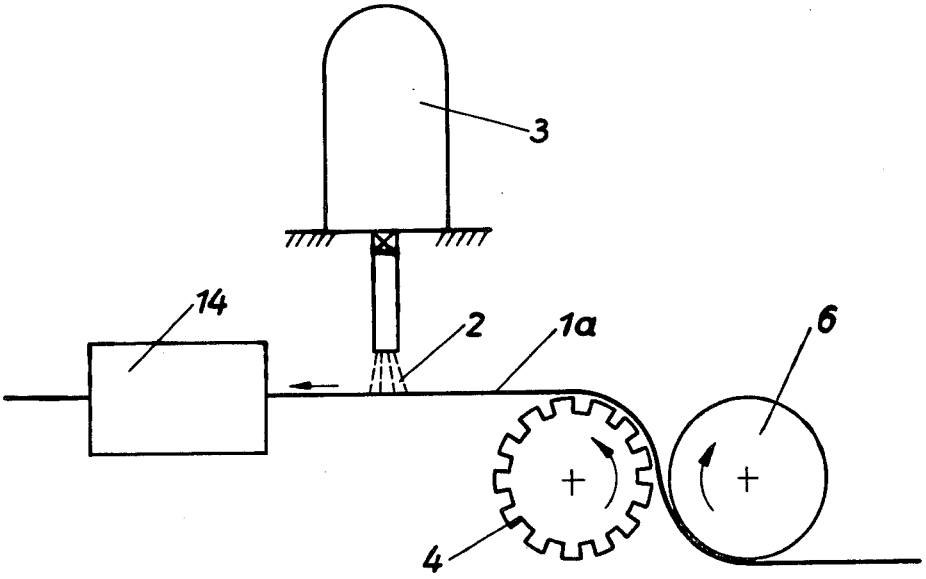
FIG. 6 is a diagrammatic side-elevational view illustrating an embodiment utilizing a profiled heated roller which acts on the article to be treated prior to irradiation.

In the embodiment of FIG. 6 we have illustrated a sheet material foil—rather than a fabric—1*a* of high-pressure polyethylene which moves in the direction indicated by an arrow, that is, towards the left in FIG. 6. It initially contacts a cooling roller 6 and thereafter a profiled roller 4 which is heated to approximately 100° C. Immediately after the thus-obtained localized heating, which is due to the higher or raised portions of the profiled roller 4, the foil 1*a* is passed through the electron beam 2 of the electron accelerator 3 at a speed such that the foil 1*a* absorbs a radiation dose of $8.10^6$ rad.

Subsequently, the foil 1*a* passes into a hot-air tunnel 14 which is heated to 140° C., or at least to approximately that temperature, whereby structurizing of the foil 1*a* is obtained.

It will be appreciated that, according to the present invention, locally acting heat, particularly applied before the irradiation, results in the obtention of a texturizing and/or structurizing effect when the filament or sheet material element is treated requisitely such as, for instance, by passing it through a hot-air tunnel after the irradiation. In those portions of the article being treated which have been locally heated before undergoing irradiation, the cross-linking which is initiated by the irradiation is advantageously influenced so that, during a subsequent heat treatment, a texturizing and/or structurizing effect occurs because the portions of the article which are less cross-linked will shrink to a different extent than those portions which are cross-linked to a greater degree.

A further particularly advantageous aspect of the present invention resides in the fact that, by suitable choice of a treating medium such as, for example, a monomeric substance possessing hydrophilic characteristics, it is also possible to obtain, at the same time, color patterns and other desired characteristics such as, for instance, a desired "hand", in textile filaments and materials.

It has been mentioned that hot air and hot water may at times serve as shrink-preventing media and at times may serve as shrinkage media. To explain further, it is pointed out that hot air and hot water function as shrink-preventing media when these are applied locally, that is, when these are applied to localized regions or areas similarly to the manner in which a hot, profiled roller applies heat to localized regions or areas. The effect of applying hot air and/or hot water locally is that the chemically active species formed during the radiation are thus locally deactivated or, in other words, deactivated in the localized regions or areas to which the hot air and/or the hot water are applied. As a result, no chemical reaction is able to occur at these localized regions.

On the other hand, hot air and hot water function as shrinkage media when these are applied homogeneously, that is, uniformly, over the entire polymeric article. In this case, all those regions which have not been treated with some shrink-preventing medium so as to make them skrink-resistant will shrink.

To summarize this, heat possesses the ability to effect a certain degree of shrinkage of polymeric materials inherently without chemical reaction while, at the same time, possessing the ability to deactivate the chemically active species formed during irradiation. Thus, when applied locally, heat may cause a certain degree of shrinkage in the regions to which it is applied but will serve as a shrink-preventing medium by deactivating the chemically active species in these regions thereby preventing the greater shrinkage which would otherwise occur by chemical reaction of these chemically active species. On the other hand, when localized regions of a polymeric material are treated with a medium so as to either make them resistant to shrinkage altogether or to make them resistant to further shrinkage, homogeneously applied heat will then act as a shrinkage medium because of its ability to effect shrinkage of the remaining regions of the polymeric material which are not treated so as to make them resistant to shrinkage.

The following Examples are intended to further illustrate the invention and are not to be construed as limiting the invention in any manner;

EXAMPLE 1

A polyamide-silk sheet material fabric of warp texture having a mass per unit area of 100 grams per square meter is contacted for a period of 2 minutes with a 20 percent acrylic acid solution at a temperature of 40° C. Subsequently, the fabric is wrung to a moisture content of 100 percent in a wringing or squeezing apparatus. The fabric is locally irradiated with an electron beam and the radiation dose is 5 Mrad. The localized irratiation is performed by directing the electron beam to localized regions of the fabric. Grafting of the acrylic acid onto the fabric occurs at the irradiated regions whereby localized shrinkage is produced which results in a three-dimensional or volumetric faulting (structuring). The three-dimensional faulting is enhanced by a subsequent treatment with hot water at 100° C.

EXAMPLE 2

A polyamide sheet material fabric of warp texture having a mass per unit area of 100 grams per square meter is homogeneously irradiated with an electron beam so that a radiation dose of 10 Mrad is achieved. By contacting the fabric with a heated roller having a profiled outer surface, localized destruction of the radicals produced by the homogeneous irradiation occurs. The temperature of the outer surface of the heater roller is 120° C. and the contact time is 2 seconds. Subsequently, the fabric is contacted for a period of 5 minutes with a 15 percent aqueous solution of acrylamide at a temperature of 40° C. As a result, grafting of the acrylamide onto the polymeric substance, that is, the fabric, occurs in those regions where the radicals were not destroyed by contact with the heated roller. Consequently, shrinkage, that is, a three-dimensional or volumetric faulting, of the fabric is produced. Subsequently, the fabric is washed and dried.

EXAMPLE 3

A polyamide-silk fabric having a width of 2 meters and a mass per unit area of 100 grams per square meter is irradiated with an electron beam having an energy of 500 kilo electron volts. The irradiation is accomplished by regulating or varying the intensity of the electron beam. During the impulse period of 0.1 milliseconds, the beam current changes in triangular manner (as seen on a plot of time versus beam current) from 0 to 20 and then from 20 to 0 milliampers. The scanning frequency of the electron beam is 50 Hertz and the diameter of the electron beam is 2 millimeters (the dimension "a" of FIG. 2). The pulsing frequency is 5 Hertz and the pulse length or period is 0.1 milliseconds. After five passes, the electron beam is phase-shifted by one pulse period. As a result of this variation in the intensity of the beam, a radical gradient is achieved in the fabric, that is, different numbers of radicals are formed over the width of the regulated or irradiated region, i.e. a concentration gradient of the radicals is produced. These differences in the number of radicals lead to differences in shrinkage after grafting with a 20 percent acrylamide solution and thereby lead to a patterning of the fabric.

EXAMPLE 4

A fabric is treated in the manner described in Example 2. Here, however, contact with the profiled, heated roller takes place already during the irradiation. The same effects as in Example 2 are produced.

EXAMPLE 5

A fabric is treated in the manner described in Example 2. Here, the heated roller is used as a shrink-preventing medium before the irradiation and a monomeric substance is used as the shrinkage medium. The same effects as outlined in Example 2 are produced.

It will be understood that each of the elements described above, or two or more together, may also find a useful application in other types of processes differing from the types described above.

While the invention has been illustrated and described as embodied in the treatment of high-polymer materials, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. The process of texturing a high polymer textile material comprising the steps of moving a beam of homogeneous high energy irradiation so as to impinge upon the material and to cause formation of chemically active species in said material, subjecting selected localized surface areas of the material to a heat treatment prior to or after said irradiation for a sufficient time to destroy or prevent the formation of said active species in said areas; and finally treating the material with a shrinking medium by reaction with said chemically active species so as to cause a differential shrinkage between said heat treated and said non-heat treated areas and thus accomplishing a texturing effect.

2. The process of claim 1 wherein the heat treatment is effected homogeneously following the irradiation step so as to deactivate or destroy the previously activated species in the localized heated areas.

3. The process of claim 1 wherein the heat treatment is effected prior to the irradiation step so as to make the high polymer non-responsive to the radiation in the localized heated areas and thus to prevent the formation of chemically active species in these areas.

4. The process of claim 1 wherein the heat treatment is effected by contacting the material with a heated profiled roller or with a heated knife edge.

5. The process of claim 1 wherein the treatment with the shrinking medium is effected by passing the material through a bath containing a solution of the shrinking medium.

6. The process of claim 1 wherein the high-polymer material is composed of a resin adapted to develop free radicals or ions under the action of irradiation.

7. The process of claim 1 wherein the high-polymer material is selected from the group consisting of polyamides, polyesters, polyolefins, cellulose and polyacrylonitriles.

8. The process of claim 7 wherein the high-polymer material is selected from the group consisting of polyamide-6, polyamide-6.6, polyethylene terephthalate, polyethylene, polypropylene, polyacrylonitrile homopolymer and polyacrylonitrile copolymer.

9. The process of claim 1 wherein the irradiation is effected by an electron beam accelerator.

10. The process of claim 1 wherein the shrinking medium is a monomeric vinyl compound.

11. The proceess of claim 1 wherein the shrinking medium is selected from the group consisting of acrylamide, acrylic acid, styrene, acrylonitrile, itaconic acid, divinylbenzene, and triallylcyanurate.

12. The process of claim 1 wherein the shrinking medium is a monomeric compound which is grafted upon the high-polymer material in the irradiated areas other than said heat-treated areas.

13. The process of claim 1 wherein the high-polymer material is subjected to said heat treatment of localized areas at about 70° to 200° C. subsequent to irradiation from an electron beam accelerator followed by passing the material at an elevated temperature through a bath of a solution of a monomeric material thereby causing grafting of the monomeric material upon the irradiated portions of the high polymer material other than said heat treated localized areas so as to effect said differential shrinkage.

14. The process of claim 1 wherein the heat treatment is effected by exposing localized areas of the material to hot air, hot water or steam.

15. The process of claim 1 wherein the treatment with the shrinking medium is effected by exposing the material throughout its surface to hot air, hot water or steam or by passing the material through a hot air tunnel, the said treatment step being effected at a temperature of 80° to 150° C.

16. The process of claim 1 wherein the high energy radiation is of an energy of between about 100 keV and 3 MeV.

17. The process of claim 1 wherein the radiation dose is between $5.10^5$ to $5.10^7$ rad.

18. The process of claim 1 wherein the time of the heat treatment is between 0.2 and 20 seconds at a temperature between 70° and 200° C.

* * * * *